US005715767A

United States Patent [19]

Cohen et al.

[11] Patent Number: 5,715,767

[45] Date of Patent: Feb. 10, 1998

[54] RIBBON EMBROIDERY APPLIQUE AND METHOD

[75] Inventors: Ivan Cohen, Westfield; Marliese H. Krivobok, Plainfield, both of N.J.

[73] Assignee: Westwater Enterprises, L.P., Mountainside, N.J.

[21] Appl. No.: 619,128

[22] Filed: Mar. 20, 1996

[51] Int. Cl.[6] ..... D05C 15/00; D05C 17/00

[52] U.S. Cl. ..... 112/439; 112/475.22

[58] Field of Search ..... 112/475.18, 409, 112/410, 411, 439, 152, 475.22, 475.23, 98, 99, 100, 80.03, 83; 156/90; 428/5

[56] References Cited

U.S. PATENT DOCUMENTS

| | | | |
|---|---|---|---|
| 1,608,430 | 11/1926 | Rosenberg | 112/475.18 |
| 1,646,383 | 10/1927 | Becker | 112/439 X |
| 3,383,270 | 5/1968 | Nimmo, Jr. | 428/5 |
| 4,450,782 | 5/1984 | Tortell | 112/475.18 |
| 4,867,081 | 9/1989 | Büchele | 112/83 |

OTHER PUBLICATIONS

Camela Nitschke, *Ribbonwork Flowers,* Threads, May 1996, at 30–35.

*Primary Examiner*—Ismael Izaguirre

*Attorney, Agent, or Firm*—Lerner, David, Littenberg, Krumholz & Mentlik

[57] ABSTRACT

A ribbon embroidery appliqué is formed by stitching silk ribbon through a fabric backing. Stitches appearing on the front side of the backing create a pattern. The stitches and the backing are stabilized by applying a layer of glue to the rear of the backing and to the ribbon on the rear of the backing. The backing is trimmed closely around the pattern formed by the ribbon. The ribbon embroidery appliqué may be attached to a garment or a household item using reusable glue or other methods.

23 Claims, 2 Drawing Sheets

RIBBON EMBROIDERY APPLIQUE AND METHOD

BACKGROUND OF THE INVENTION

Ribbon embroidery is a known means for decorating garments, linens and other fabric products. As currently practiced, ribbon embroidery comprises stitching lengths of ribbon through a garment or other fabric article using a needle. On the side of the fabric on which the design is to be formed, each stitch of ribbon is looped or knotted. The color and configuration of those loops and knots form the pattern of the ribbon embroidery. By varying the size of the knots and the length of the loops, complex three dimension patterns such as flowers, pictures and borders may be formed.

Ribbon embroidery, therefore, has several advantages over conventional embroidery such as cross-stitch. First, the three-dimensional effect possible with ribbon embroidery is not possible using thread. Second, because the ribbon itself is formed of a fabric, various patterns and textures present on the ribbon may be used in the embroidery to create pleasing effects.

Ribbon embroidery, however, has several important drawbacks that have prevented this craft from reaching the popularity of other needlework arts in the decoration of garments, linens, and products used in household decor. For reasons explained below, clothing manufacturers and retailers almost never incorporate ribbon embroidery into their garment lines. In order for a consumer to obtain an article of clothing displaying a ribbon embroidery motif, he or she must first select and purchase the garment upon which the motif will be created. The consumer could then execute the ribbon embroidery himself or herself. This is a highly skilled and time-consuming task, and a stitching error could destroy the garment if the resulting holes in the garment could not be covered or repaired. Alternatively, the consumer could find one of the few embroidery technicians skilled in ribbon embroidery and pay a large commission to have the custom work done. Neither of these alternatives is attractive to the average consumer. For this reason, ribbon embroidery, with all its aesthetic advantages, has not become as commercially successful as some other decorative arts.

In addition, ribbon embroidery is often far less robust than the articles to which it is applied. Because the patterns formed in ribbon embroidery depend on delicate knots in the ribbon and on loops that extend outward from the fabric surface, ribbon embroidery should be washed by hand to avoid damaging the ribbon configuration. Furthermore, the material used in the ribbon itself, which is typically silk, will likely require more delicate care than the article of clothing with which it is incorporated. Thus, for example, a designer denim jacket that is normally machine washable must be handwashed in cold water after a ribbon embroidery motif is applied. This inconvenience further discourages the use of ribbon embroidery with apparel.

In addition to presenting maintenance problems, ribbon embroidery may also limit the versatility of the article of clothing on which it has been executed. For example, many ribbon embroidery motifs have seasonal themes, such as spring flowers or autumn leaves. By embroidering such a design onto an otherwise versatile article of clothing, the practical use of that article is limited to the season represented by the motif.

The versatility of clothing bearing ribbon embroidery is further limited because that clothing should be worn as an outside layer. Additional layers of clothing worn on top of ribbon embroidery tend to crease the ribbon, destroying the three-dimensional effect of the motif. For this reason, a consumer will hesitate to purchase a garment having ribbon embroidery because the garment cannot be worn under a coat or sweater.

Finally, ribbon embroidery as practiced today is impractical to market commercially. Ribbon embroidery motifs are typically manufactured by hand, due to the complex nature of the stitches. Because of the high cost associated with that skilled labor, an individual garment sold with a ribbon embroidery pattern must be priced well outside the normal price range for a non-ribbon embroidered version of the garment.

In sum, to acquire an article having a ribbon embroidery design, a consumer must have the ribbon embroidery done by a custom embroiderer or do it himself or herself. After completing this expensive or time consuming undertaking, the consumer must be satisfied with an article having reduced versatility and convenience. For these reasons, ribbon embroidery has not been a popular method of decorating garments.

Appliqués using certain other decorative materials are known in the art. For example, beads or sequins are commonly attached to a sheer backing by stitching or by using glue. The resulting appliqué, comprising beads or sequins, sheer material and glue, is typically applied to a garment. Such appliqués have been made removable, so that they may be used on more than one garment.

Bead or sequins appliqués, and appliqués using other non-ribbon decorative materials, lack the unique and marketable aesthetic properties of ribbon embroidery. None combine the three-dimensional capability of ribbon embroidery with the brilliant colors available through the use of silk ribbons.

Further, because other decorative materials are not wide like ribbon, none can duplicate the designs and patterns that can be created in ribbon embroidery by twisting and knotting ribbons.

SUMMARY OF THE INVENTION

In the present invention a ribbon embroidery motif is applied to silk organza or another backing material by stitching the ribbon through the backing in the manner known in the ribbon embroidery art. The resulting ribbon embroidery applique, including the backing sheet, may then be either permanently or temporarily applied to a garment, a linen, a fabric or any decorative product. That appliqué permits ordinary consumers to utilize ribbon embroidery in their wardrobe and home decor without the expense of hiring a custom embroiderer or the investment of time required to learn and execute the ribbon embroidery art. In instances where the ribbon embroidery appliqué is only temporarily attached to the fabric product, the appliqué may be removed for washing or other maintenance of the fabric. Further, the ribbon embroidery appliqué may be used on more than one garment or other fabric product. Simply stated, the appliqué is selectively removable from the items to which it has been applied. This permits an increased use of the investment made in the ribbon embroidery.

In one embodiment of the invention, a ribbon embroidery appliqué comprises a backing sheet having a top surface and a bottom surface, a ribbon stitched through the backing sheet to form a pattern on the top surface and to form connecting stitches on the bottom surface, and stabilizing means for stabilizing the connecting stitches and the backing. The glue affixes the ribbon in the pattern and prevents the backing from fraying.

In another embodiment of the invention, a method is provided for applying ribbon embroidery to an article. That method comprises providing a backing sheet, stitching a ribbon through the backing sheet to form a ribbon embroidery pattern or design on one side of the backing, applying a glue to the other side of the backing, trimming the backing around the pattern, and affixing the embroidered backing to the article. The backing may be affixed to the article by using reusable adhesive, by stitching, by using a permanent adhesive, by affixing hook and loop connecting fabric, or by using any other suitable fastening means.

By providing for the use of ribbon embroidery on a removable appliqué, the invention solves the long-standing problem of making ribbon embroidery available to the average consumer without the necessity of a large cash outlay for custom embroidery, and without a large time commitment to do the work himself or herself. Instead, a distributor can market completed ribbon embroidery appliqués to the consumer for the decoration of garments or home decor items. Because the backing is sheer and trimmed close to the embroidered pattern, the appliqué is difficult or impossible to distinguish from ribbon embroidery done directly onto the decorated article.

The invention also makes possible the convenient laundering or cleaning of items on which the ribbon embroidery is used without damaging the ribbon embroidery itself. The ribbon embroidery appliqué of the invention may be removed from an article before the article is laundered. The appliqué may also be transferred from garment to garment, making it more versatile and practical than existing ribbon embroidery techniques.

Pricing of ribbon embroidery is made more palatable to the consumer through use of the present invention. Formerly, the price of the ribbon embroidery was a cost added to the cost of a particular item of clothing. In contrast, the ribbon embroidery appliqué of the invention may be marketed as a separate accessory item. Consumers are known to be willing to pay a comparatively high price for clothing accessories.

Alternatively, the ribbon embroidery appliqué of the invention may be sold in connection with a single item of clothing for use with that item as well as items in the buyer's wardrobe. The consumer in that case would be more willing to pay the increased price of the package.

DETAILED DESCRIPTION

Figure 1A:
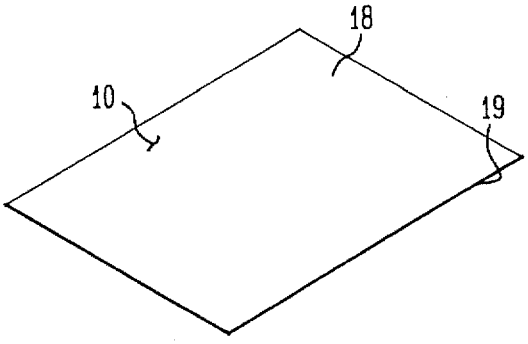
FIG. 1A is a perspective view of a backing sheet as used in a method of the invention.

The process of creating a ribbon embroidery appliqué according to the invention is illustrated in FIGS. 1A to 1F. The process begins by providing a backing sheet as shown in FIG. 1A. A sheer silk organza backing is preferred because that material is less visible below the ribbon embroidery when the appliqué is in use. However, other strong, flexible and sheer materials such as synthetic backing materials may be used.

In one embodiment of the method, a single ribbon embroidery appliqué is manufactured using a single backing sheet 10 as shown in FIG. 1A. In that case, the backing sheet must be large enough to encompass the ribbon embroidery pattern to be manufactured from the sheet. In an alternative embodiment shown in FIG. 4, multiple ribbon embroidery appliqués 51 are manufactured using a single backing sheet 50. In that case, the sheet 50 must be large enough to accommodate the multiple ribbon embroidery appliqués.

Figure 1B:
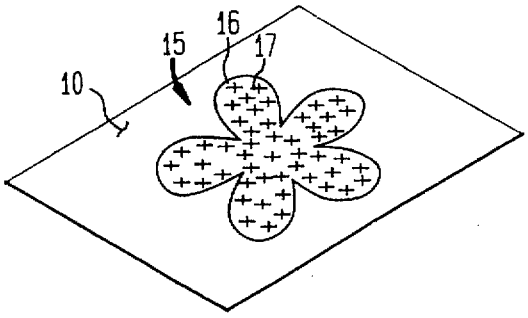
FIG. 1B is a perspective view of the backing sheet of FIG. 1 after the step of pre-marking.

A pattern 15, representing the ribbon embroidery design, is next applied to the backing sheet 10, as shown in FIG. 1B. In a preferred embodiment, the pattern is applied in ink, although other substances such as colored chalk may also be used. The pattern 15 comprises an outline 16 demarcating the outer boundary of the completed ribbon embroidery appliqué, and an embroidery pattern 17, indicating the individual stitch locations within the pattern. The embroidery pattern 17 may be coded using colors or symbols to indicate the type or color of ribbon to be used in each stitch location. Additional codes may be embedded in the pattern to indicate the type of ribbon stitch or knot to be used at each location.

Figure 1C:
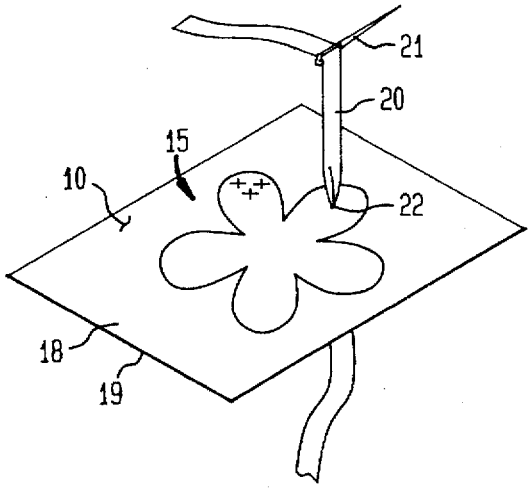
FIG. 1C is a perspective view of the ribbon embroidery appliqué during the stitching step.
Figure 1D:
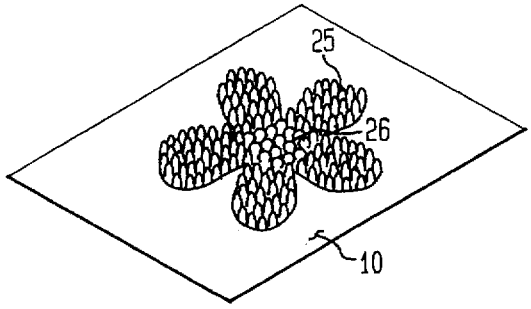
FIG. 1D is a perspective view of the ribbon embroidery appliqué immediately after the stitching.

After applying the pattern 15 to the backing sheet 10, the ribbon embroidery step is performed as shown in FIG. 1C. Ribbon 20 is passed from the bottom surface 19 of the backing sheet 10, through the backing sheet, to the top surface 18. Each stitch of the ribbon 20 is made at a location such as location 22 marked in the embroidery pattern 17. The ribbon is passed through the backing sheet using a needle 21. In the currently preferred embodiment, the ribbon embroidery is stitched by hand.

As is known in the art, an image or picture is formed by the individual stitches of the ribbon embroidery. The stitches may be varied by varying the color and texture of the ribbon, by tying knots in the individual stitch, by interlocking stitches, by twisting the ribbon within a stitch, and by varying the length of the loop left on the top surface of the backing. For example, in the finished ribbon embroidery design of FIG. 1D, the center of the flower is formed by knotted ribbons 26 which form a low solid mass, while the petals are formed by larger loops 25 forming a softer, looser texture and giving the flower relief.

Figure 1E:
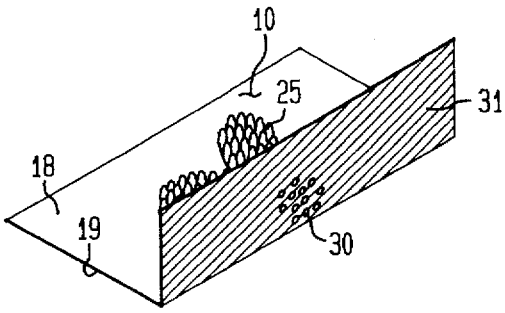
FIG. 1E is a perspective view of the ribbon embroidery appliqué after applying glue to the bottom surface.

The backing sheet and ribbons are next stabilized as shown in FIG. 1E. Retaining knots 30 comprising knots, stitches and loose ribbon are formed by the termination of stitches 25 on the bottom surface 19 of the backing. It is important that the retaining knots be stabilized in order to prevent alteration of the ribbon embroidery design that could be caused by abrasion or pulling on the retaining knots. In addition, a failed knot on the bottom surface of the backing could cause a ribbon stitch to come out, resulting in an unsightly loose ribbon on the top surface of the backing. Stabilization of the knots has been found especially important where the ribbon embroidery appliqué is to be reused, subjecting the bottom surface of the backing sheet to additional wear. In addition, the backing itself is subject to fraying at its edges after the ribbon embroidery appliqué is cut from the backing sheet.

In a preferred embodiment, a layer of stabilizing glue 31 is applied to the bottom surface 19 of the backing 10 as well as to the retaining knots, to stabilize the appliqué. After drying, the glue prevents the backing from fraying and secures the retaining knots. The glue must have some flexibility and little or no color when dry. Further, the glue must be compatible with the ribbon and backing materials.

Other methods of stabilization may also be used. For example, in the case where the synthetic ribbon and backing are used, these materials may be subjected to a flame or other localized high temperature in order to melt the fibers together to prevent untying and fraying. This may be done after cutting the appliqué from the surrounding backing.

Figure 1F:
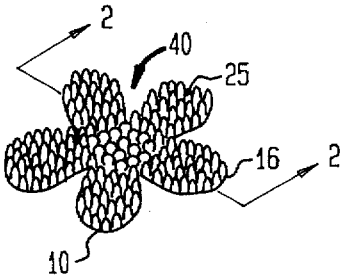
FIG. 1F is a perspective view of the completed ribbon embroidery appliqué.

The final ribbon embroidery appliqué is formed by cutting the ribbon embroidery design from the surrounding backing sheet 10, as shown in FIG. 1F. The pattern outline 16, applied to the backing during the same step that the embroidery was applied, is used as a guide in cutting around the embroidery design. The stitches 25 are accurately located within the pattern outline 16 because both were printed at the same time.

Scissors are typically used to cut the ribbon embroidery design from the backing sheet by hand. In an alternative embodiment, a punch and dye arrangement is used to separate the ribbon embroidery appliqué from the remainder of the backing. In either case, both the backing sheet 10 and the layer of glue 31 are severed together in this step. Because the backing is coated on its bottom surface with glue, the backing is prevented from fraying, even in a design where intricate shapes are cut. This is especially important where a sheer silk organza is used as backing. The glue also serves to stiffen and strengthen the final ribbon embroidery appliqué, which may contain thin sections in its design.

Figure 4:
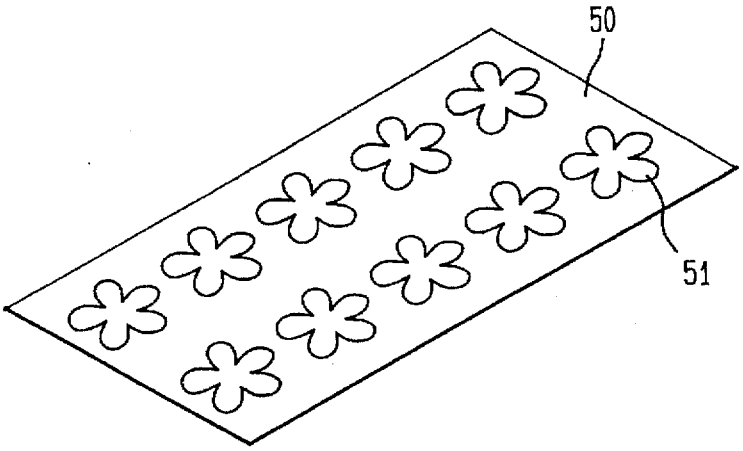
FIG. 4 is a perspective view of a backing sheet of an alternative method of the invention having multiple ribbon embroidery patterns.

While the step of trimming the ribbon embroidery appliqué from the backing sheet is preferably done by the manufacturer before packaging and shipping the appliqué, the appliqué may alternatively be shipped untrimmed. In that embodiment, the consumer trims the appliqué from the backing before using it, saving the labor costs associated with the trimming operation. In this embodiment, sets of appliqués, such as appliqués representing the four seasons, may be stitched on a single backing sheet as shown in FIG. 4 for sale as a unit.

Figure 2:
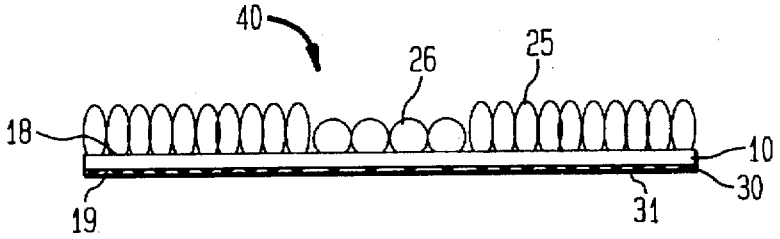
FIG. 2 is a sectional view through line II—II of FIG. 1F.

The final ribbon embroidery appliqué, as manufactured using the method of the invention, is shown in FIG. 2. Ribbon knots 26 and ribbon loops 25 form the embroidery design on the top surface 18 of the backing sheet 10. The ribbon passes through the backing 10 and out the bottom surface 19, forming the retaining knots 30 on the bottom surface of the backing. A stabilizing means such as a layer of stabilizing glue 31 coats the retaining knots 30 as well as the bottom surface 19 of the backing 10, stabilizing the knots and loose ribbon and preventing the backing 10 from fraying along its edges.

The ribbon forming knots 26 and loops 25 is preferably silk, although other material may be used. Similarly, the backing sheet 10 is preferably a sheer silk organza.

Figure 3:
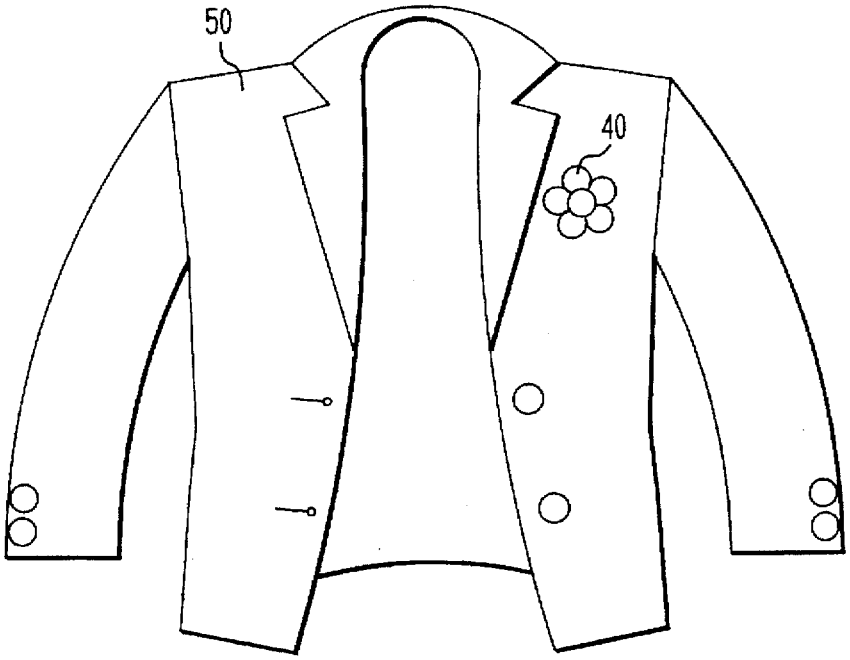
FIG. 3 is a front elevational view of a garment after applying a ribbon embroidery appliqué.

To use the ribbon embroidery appliqué 40 of FIG. 2, the appliqué is applied to a garment, linen or other household item. Several methods of attachment may be used. First, a reusable adhesive, such as Tack-it over and over ® marketed by Aleene's Division of Artis, Inc., of Buelton, Calif., may be used to affix the ribbon embroidery appliqué 40 to an article of clothing such as jacket 50 shown in FIG. 3, or to another article of clothing or household item. By using a reusable adhesive, the user is able to transfer the ribbon embroidery appliqué from one article to another, adding considerable diversity to his or her wardrobe. Further, an article of clothing is more easily laundered with the appliqué removed.

Alternatively, the user may use a permanent adhesive to attach the ribbon embroidery appliqué to a garment or other item. This is especially useful when using the ribbon embroidery appliqué on an article used in home decor, such as a decorative photo album. The appliqué may also be attached to fabric items using stitching. This forms a semi-permanent attachment useful because it is less likely to fall off than is an appliqué attached by reusable glue, yet it may be removed by cutting the stitches.

The ribbon embroidery appliqué of the present invention may be used to change the seasonal aspect of an article of clothing. For example, the ribbon embroidery appliqués may be sold as a kit including four separate motifs for summer, fall, winter and spring. These are attached in rotation to a single article of clothing using the reusable or stitching methods of attachment. In that way, a single article of clothing may adjusted in appearance to fit the seasons of the year.

It is understood that the above-described embodiments are merely illustrative and that many variations can be devised by those of skill in the art without departing from the scope of the invention.

We claim:

1. A ribbon embroidery appliqué comprising:

a backing having a top surface, a bottom surface and an outer edge; and a ribbon stitched through said backing to form a design on said top surface and retaining knots on said bottom surface;

said outer edge of said backing conforming to said design.

2. The ribbon embroidery appliqué of claim 1, further comprising means for stabilizing said retaining knots.

3. The ribbon embroidery appliqué of claim 1, further comprising means for stabilizing said backing.

4. The ribbon embroidery appliqué of claim 1, further comprising a layer of glue applied over said retaining knots and said backing for stabilizing said retaining knots and said backing.

5. The ribbon embroidery appliqué of claim 1, further comprising means for stabilizing said retaining knots and said backing.

6. The ribbon embroidery appliqué of claim 1, wherein said ribbon is silk.

7. The ribbon embroidery appliqué of claim 1, wherein said backing is sheer silk organza.

8. A method of manufacturing a ribbon embroidery appliqué, comprising:

providing a backing sheet having a top surface and a bottom surface;

stitching a ribbon through said backing sheet to form a ribbon embroidery design on said top surface and retaining knots on said bottom surface;

stabilizing said backing sheet and said retaining knots; and cutting said backing sheet to conform to said ribbon embroidery design.

9. The method of claim 8, further comprising the step of printing a pattern on said backing sheet.

10. The method of claim 8, wherein said backing sheet is sheer silk organza.

11. The method of claim 8, wherein said ribbon is silk ribbon.

12. The method of claim 8, wherein said stabilizing step comprises applying a layer of glue over said bottom surface of said backing sheet and over said retaining knots.

13. An article having a ribbon embroidery motif, comprising a backing having a top surface and a bottom surface;

a ribbon stitched through said backing to form a design on said top surface and retaining knots on said bottom surface;

means for stabilizing said retaining knots and said backing; and means for affixing said bottom surface of said backing to the article.

14. The article of claim 13, wherein said means for affixing said bottom surface to the article comprises a reusable adhesive.

15. The article of claim 13, wherein said means for affixing said bottom surface to the article comprises a permanent adhesive.

16. The article of claim 13, wherein said means for affixing said bottom surface to the article comprises thread stitches.

17. The article of claim 13, wherein said means for affixing said bottom surface to the article comprises a hook and loop connector.

18. A ribbon embroidery appliqué comprising:

a backing having a top surface and a bottom surface;

a ribbon stitched through said backing to form a design on said top surface and retaining knots on said bottom surface; and means for stabilizing said retaining knots.

19. The ribbon embroidery appliqué of claim 18, further comprising means for stabilizing said backing.

20. The ribbon embroidery appliqué of claim 18, further comprising a layer of glue applied over said retaining knots and said backing for stabilizing said retaining knots and said backing.

21. The ribbon embroidery appliqué of claim 18, further comprising means for stabilizing said retaining knots and said backing.

22. The ribbon embroidery appliqué of claim 18, wherein said ribbon is silk.

23. The ribbon embroidery appliqué of claim 18, wherein said backing is sheer silk organza.

* * * * *